United States Patent [19]

Schieber et al.

[11] 4,100,767

[45] Jul. 18, 1978

[54] KNITTING MACHINE PATTERN MECHANISM

[75] Inventors: Hans Schieber, Bopfingen; Reinhold Schimko, Aalen-Wasseralfingen, both of Germany

[73] Assignee: Universal Maschinenfabrik Dr. Rudolf Schieber KG, Westhausen, Germany

[21] Appl. No.: 841,420

[22] Filed: Oct. 12, 1977

[30] Foreign Application Priority Data

Oct. 14, 1976 [DE] Fed. Rep. of Germany ..... 2646410

[51] Int. Cl.[2] ..... D04B 7/00

[52] U.S. Cl. ..... 66/75.2

[58] Field of Search ..... 66/75.2, 154 A

[56] References Cited

U.S. PATENT DOCUMENTS

| | | | |
|---|---|---|---|
| 3,715,897 | 2/1973 | Madam | 66/75.2 |
| 3,717,014 | 2/1973 | Kohler | 66/75.2 |
| 3,913,354 | 10/1975 | Kohler et al. | 66/75.2 |
| 3,974,664 | 8/1976 | Erb | 66/75.2 |
| 4,041,732 | 8/1977 | Krause | 66/75.2 |

FOREIGN PATENT DOCUMENTS

| | | | |
|---|---|---|---|
| 2,412,497 | 9/1975 | Fed. Rep. of Germany | 66/75.2 |

*Primary Examiner*—Ronald Feldbaum

*Attorney, Agent, or Firm*—Sughrue, Rothwell, Mion, Zinn and Macpeak

[57] ABSTRACT

A pattern mechanism for a flat knitting machine, has pattern sinkers lowered into and raised from the needle bed by pattern levers, or pattern sinkers movable in the direction of needle movement, the pattern levers, or the pattern sinkers movable in the needle direction having feet in staggered formation. At each passage of a selection point on a cam means, the pattern levers are lowered to the needle bed and held in, half in, or fully out in accordance with the particular pattern by strip-like control members, or the pattern sinkers movable in the needle direction are controlled by lifting members. The control members are on levers in the cam means movable by respective eccentrics, or cams, or by the pattern lever feet between two of the feet located successively in the direction of movement of the cam means and are retained in selected positions by electromagnetically controlled levers.

21 Claims, 29 Drawing Figures

KNITTING MACHINE PATTERN MECHANISM

BACKGROUND OF THE INVENTION

The invention relates to a pattern mechanism for a knitting machine, particularly but not exclusively for a flat knitting machine.

In such pattern mechanisms, needle control means are provided comprising pattern sinkers, which can be lowered into and raised from a needle bed, or a cylinder in the case of cylindrical knitting machines, by means of pattern levers, or which can be moved in the direction of movement of the needles. The feet of the pattern levers, or of the pattern sinkers movable in the direction of the needles, are in staggered formation. The pattern levers, at each passage of a selection point on a cam, are lowered to the needle bed or the cylinder and held either in, or half in or fully out in accordance with the particular pattern by control members, and the pattern sinkers movable in the direction of the needles are controlled by lifting control members.

In known pattern mechanisms, pattern selection proceeds by arranging a tipping sinker or a pattern lever to be pivoted so that the foot of the pattern sinker which slides on the pattern lever, either disappears into the needle bed, or half or fully projects therefrom, whereby it can be caught by the cam means at different heights so that the needles selectively form meshes or loops or do not operate. The size of the pattern field depends upon the number of pattern sinkers or pattern levers, which are in mutually adjacent staggered formation. The number of feet in different positions staggered transverse to the needle bed is then limited by the width of the needle bed in flat knitting machines, and by the height of the cylinder in circular knitting machines.

A similar dependence of the number of feet on the size of the pattern field exists also in pattern mechanisms for knitting machines in which the pattern selection takes place by location behind the needles of pattern sinkers with staggered feet, which are movable with the needle in the direction of movement thereof and thus in a common plane.

In a second type of known knitting machine pattern mechanism, which operates with pattern sinkers, cam elements are introduced by means of magnets between the feet of the pattern sinkers or pattern levers arranged successively in the direction of cam movement. In that case also the knitting speed depends inter alia upon the number of the feet arranged in staggered formation.

In flat knitting machines in which the selection points in both travel directions of the carriage are situated at various postiions on the cam, it is necessary to provide, for each travel direction of the carriage, corresponding cam parts with associated electromagnets, which means doubling the number of the cam members and electromagnets. Finally, all the known pattern mechanisms have the disadvantage that there must be provided for transfer cams individual selection points with associated actuating devices.

The present invention has for an object the provision of a pattern mechanism of the first described type, which is simple and compact in construction.

The invention also has as an object the provision of a knitting machine pattern mechanism which ensures correct needle operation in accordance with a selected pattern, for all knitting and transfer operations which occur, by means of simply operated control members.

SUMMARY OF THE INVENTION

The invention accordingly provides that the control members are on lever means in the cam and are movable mechanically towards the needle bed, or the cylinder between two feet of the pattern levers or pattern sinkers which are located successively in the direction of cam movement, the control members being retainable in various positions with respect to the bed or cylinder in accordance with the pattern.

Preferably, the long axes of the levers providing or carrying the control members extend substantially in the direction of cam movement.

It is advantageous furthermore to provide an individual set of control members for each cam system, the number of the set corresponding to the number of feet of the pattern levers or sinkers.

In a flat knitting machine, such sets of control members are advantageously movable in common with respect to the particular selection points in the direction of the cam movement. If the flat knitting machine includes transfer devices, the sets of control members are appropriately separately mounted and selectively displaceable to different selection points in the direction of cam movement.

For retaining each control member, there can be provided electromagnets or double electromagnets, preferably controlled by electronic circuit means.

A pattern mechanism of the invention with pattern levers can be constructed so that the control members are in the form of strips mounted on single armed levers. The control strips are driven by eccentrics with relatively angularly staggered peripheries, which are rotated in synchronism with the speed of the cam relative to the needles to urge the strips toward the needle bed or cylinder against spring means tending to raise them.

Instead, a pattern mechanism of the invention has control members in the form of control strips mounted upon one arm of double armed levers. By means of actuating cams located between the feet of the pattern levers above the needle bed or the cylinder, which operate upon the other arm of the levers, the control strips are urged towards the needle bed or the cylinder against spring means.

Alternatively, a pattern mechanism of the invention with pattern levers can have control members in the form of control strips at the free end of self-resilient levers clamped at one end, so that the actuating surfaces move closely above the surface of the needle bed or the cylinder, the control strips being liftable by the action of springs acting on the pattern levers.

Where the pattern mechanism of the invention has pattern sinkers displaceable in the direction of the needles, the control members can have the form of lifting members mounted upon levers at two levels above the needle bed or the needle cylinder, the lifting inclines of the lifting members at the one level for the selection of tuck stitch knitting beginning later than the lifting inclines of the lifting members at the other level for the selection of mesh knitting. For this purpose, the lifting members are advantageously mounted at one end of double armed levers spring urged to the raised position of the lifting members, whilst cam surfaces are provided at the other end of the levers, which cause each lever to swing under the action of the foot of the adjacent pattern sinker to urge the foot of the adjacent pattern sinker to urge the lifting member towards the needle bed or the cylinder.

Other objects, features and advantages of the present invention will become apparent from the following description of practical embodiments thereof and from the accompanying drawings, in which:

DETAILED DESCRIPTION OF PREFERRED EMBODIMENTS

Figure 1:
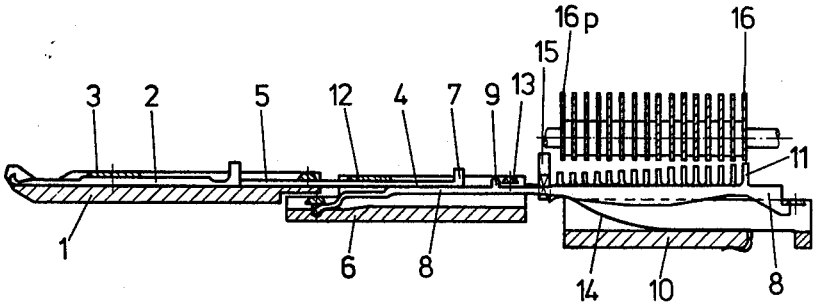
FIG. 1 is a cross section through the needle bed, the sinker bed and the pattern lever bed of a pattern mechanism with the pattern levers in the basic position.
Figure 2:
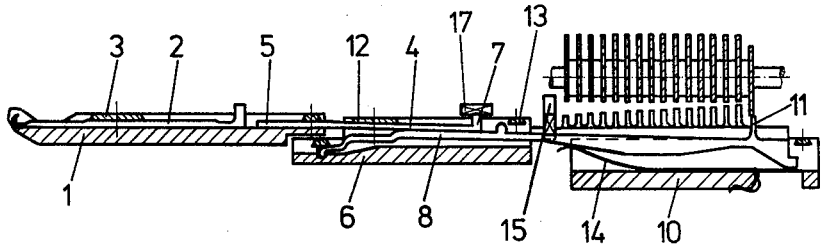
FIG. 2 is a cross section corresponding to FIG. 1 with the pattern levers in the half position.

In the FIGS. 1 to 15 there is shown a pattern mechanism for flat knitting machines with pattern levers and eccentric operated single armed levers with control strips secured thereto. In a needle bed 1, needles 2 are displaceably disposed and, by means of a cover rail 3, are so retained in the needle bed that they are unable to move upwardly from the plane of the needle bed. Pattern sinkers 4 also have their shafts 5 displaceable in the needle bed 1 and are also mounted in a sinker bed 6, from which the feet 7 of the pattern sinkers 4 project in their normal position.

Inside the sinker bed 6 the pattern sinkers 4 lie upon pattern levers 8, which limit the downward movement of the sinkers in the sinker bed 6. The pattern levers 8 are pivotally mounted in the sinker bed and are provided at the upper edges of their shafts with cams 9, whereby the movement of the pattern sinkers 4 to the rear of the needles 2 is limited. The rearward half of the pattern lever 8 is pivotally guided in a pattern lever bed 10. In this rearward region each pattern lever 8 is also provided with a foot 11.

Figure 3:
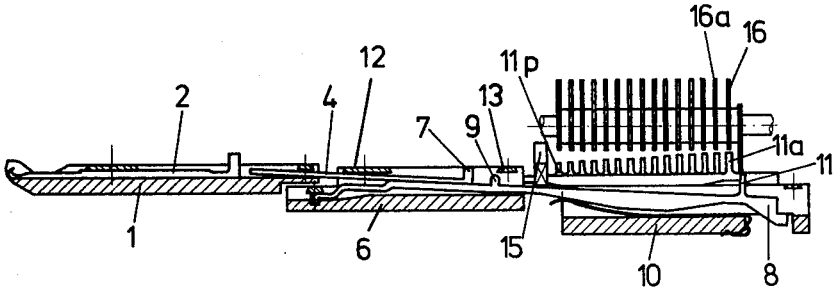
FIG. 3 is a cross-section corresponding to FIG. 1 with the pattern levers in the non-operating position.
Figure 4:
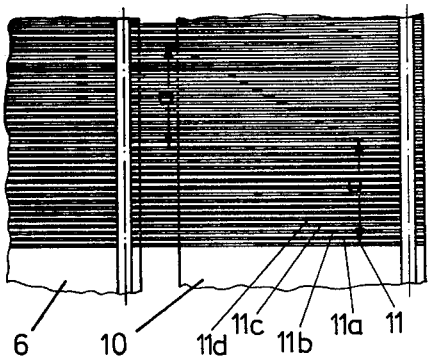
FIG. 4 is a plan view of a portion of a pattern lever bed with the feet of the inserted pattern levers in diagonally staggered formation.

The feet 11 of the pattern levers 8 arranged in adjacent relationship in the direction of cam travel, are so staggered in respect of their distance from the edge of the sinker bed 6 that, of the total number of feet, 11, 11*a*, 11*b*, 11*c*, 11*d* . . . 11*p* which are provided, the foot 11 is farthest away and the foot 11*p* is closest to the edge of the sinker bed 6, as is evident from FIGS. 3 and 4.

The pattern sinkers 4 and the pattern levers 8 are retained in the sinker bed 6 by rails 12 and 13 extending lengthwise of the sinker bed 6. They are pressed against the rails 12 and 13 by springs 14.

Figure 5:
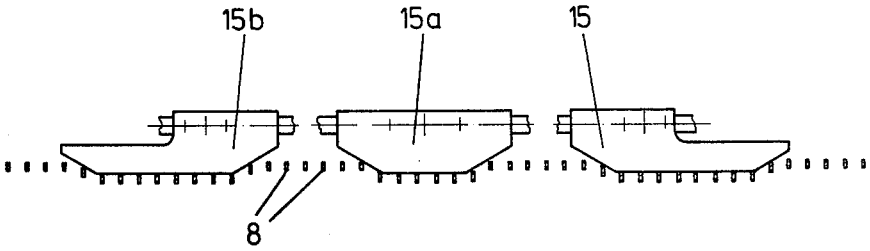
FIG. 5 is a schematic diagram showing fixed wipers, which press the pattern levers into the pattern lever bed.

Upon the carriage of the machine there are provided control strips 16, 16*a* . . . 16*p* for the feet 11, 11*a* . . . 11*p*, and wipers 15 are also provided. In the course of the passage of the carriage the wipers 15 press the pattern levers 8 into the pattern lever bed 10. When the appertaining control strips 16, 16*a* . . . 16*p* are in their lowest positions with respect to the pattern lever bed 10 and over the particular corresponding foot 11 of the pattern lever 8, these control strips prevent the spring 14 from lifting the corresponding pattern lever 8 out of the pattern lever bed 10, so that the lever remains depressed in the pattern lever bed 10. Furthermore there is provided upon the carriage a wiper 17, which before each selection point in the cam presses all of the pattern sinkers 4 into the sinker bed 6, so that the feet 7 of the pattern sinkers also remain out of engagement with the cam parts. FIG. 5 shows successive wipers 15, 15*a*, 15*b* for the pattern levers 8.

Figure 6:
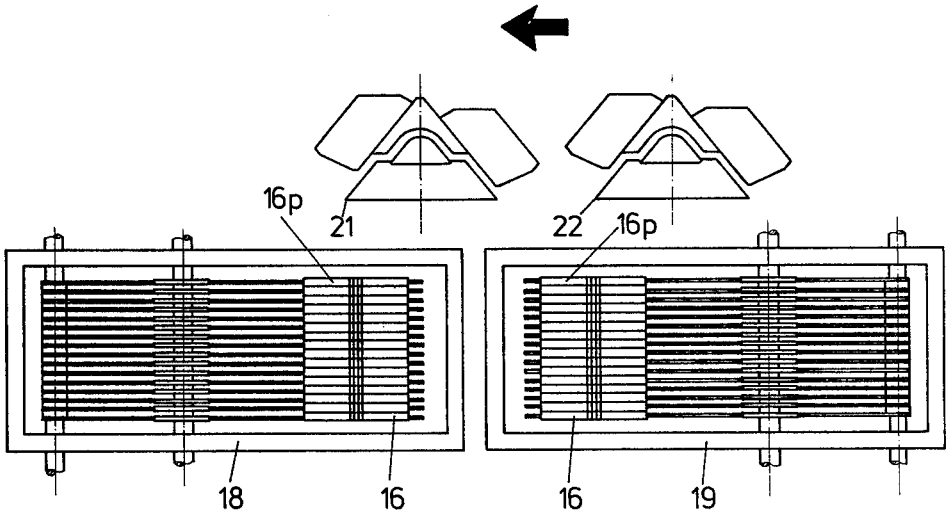
FIG. 6 is a plan view of two control member sets in their arrangement with relation to two knitting cams when knitting from right to left.
Figure 7:
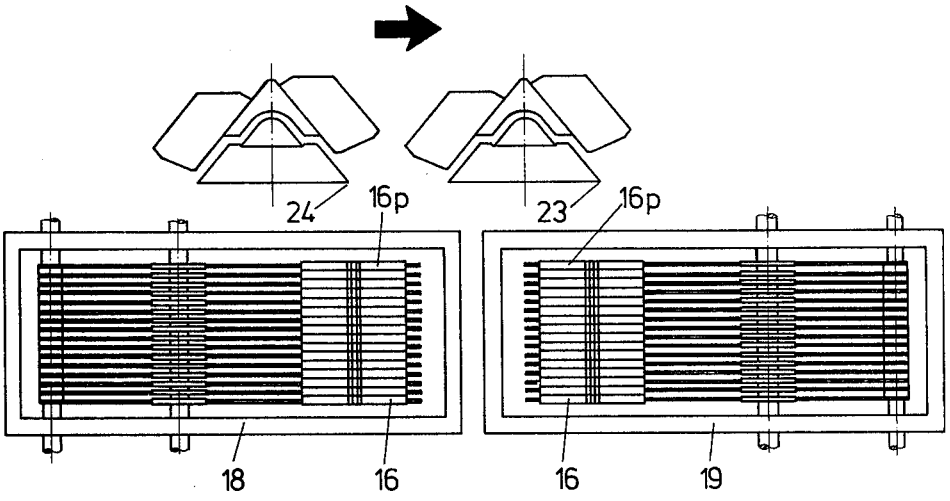
FIG. 7 is a plan view corresponding to FIG. 6 when knitting from left to right.
Figure 8:
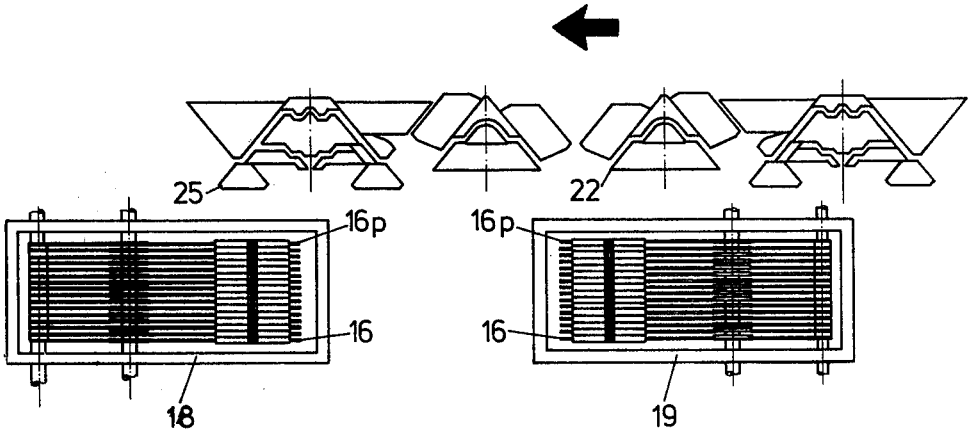
FIG. 8 is a plan view corresponding to FIG. 6 when performing transfer operations and knitting with a following cam from right to left.

The FIGS. 6 to 8 show the assembly of control strips 16 . . . 16*p* into two sets 18 and 19. In flat knitting machines, the sets 18 and 19 of control strips 16 have their position variable in the direction of carriage movement in such a manner that the actuating surfaces 20 of the control strips 16, which are clearly shown in FIGS. 9–12, are respectively located on the particular leading selection points 21 and 22 of two cams when the carriage runs from right to left, as is seen in FIG. 6. When the carriage runs from left to right these actuating surfaces 20 are then located upon the leading selection points 23 and 24 as is shown in FIG. 7.

In the case of flat knitting machines having transfer devices, the sets 18 and 19 are individually mounted and differently adjustable so that, for example, as shown in FIG. 8, the actuating surfaces 20 of the set 18 are situated at a selection point 25 of a transfer cam and the actuating surfaces 20 of the set 19 are situated at the selection point 22 of the following knitting cam.

Figure 9:
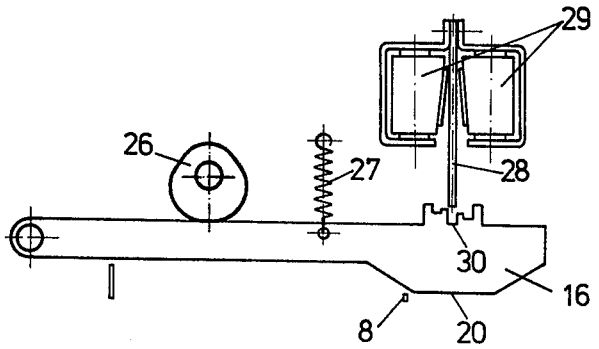
FIG. 9 is a schematic side elevation of a control strip depressed by a controlling eccentric.

In order to make it possible to select each individual needle at various operations, it is necessary for the control strips 16 to be selectable over a length of path *a*, shown in FIG. 4, between the respective feet 11 adjacently situated in the travel direction of the carriage. In the practical example here described, this selection is effected by arranging that gauge-dependent eccentrics 26 run in synchronism with the carriage movement over the needle bed, which eccentrics press the control strips 16 carrying the actuating surfaces 20 towards the pattern lever bed 10 — or in the case of circular knitting machines towards the cylinder — as is represented in FIG. 9. At the same position all of the pattern levers 8 are depressed into the pattern lever bed by the appertaining wipers 15. A spring 27 is provided to return the control strip 16 against the action of the eccentrics 26.

Figure 10:
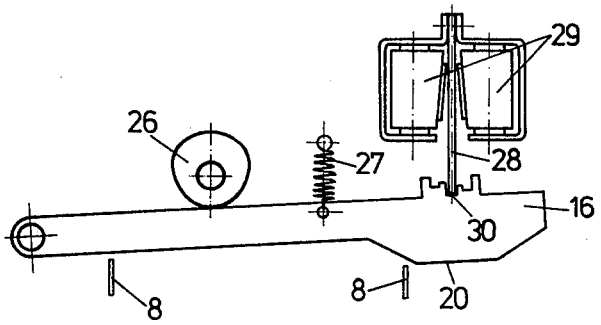
FIG. 10 is a schematic side elevation of a control strip released by the eccentric and lifted up by a spring.

When the eccentric 26 is rotated so far as to bring the lowest part of its periphery to bear against the control strip 16, the spring 27 has returned the control strip 16 into its basic position as is shown in FIG. 10.

Above the control strip 16 there is mounted a double electromagnet 29 with an armature 28 capable of being brought into three positions. When the armature 28 is in the centre position as is shown in FIGS. 9 and 10, it can move into a groove 30 at the top of the control strip 16 as shown in FIG. 10. When the control strip 16 moves over to the position shown in FIG. 10, the pattern lever 8 remains in the basic position and brings the foot of the appertaining pattern sinker fully in engagement with the following cam.

Figure 11:
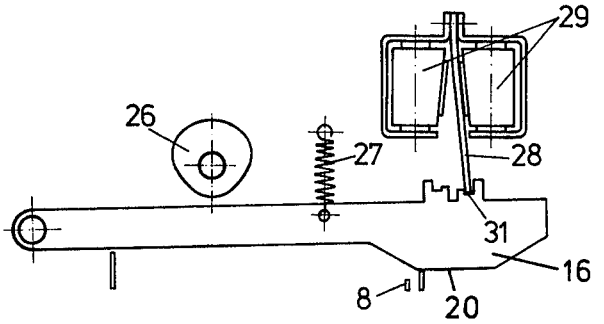
FIG. 11 is a schematic side elevation of a control strip released by the eccentric and held in the half position by a double electromagnet.

FIG. 11 shows the case, in which the armature 28 of the double magnet 29 is drawn to the right. In this case the armature 28 is received in a groove 31 of the control strip 16, whereby the control strip 16 is retained in the half position. The actuating surface 20 of the control strip 16 now allows the foot 11 of the pattern lever 8 to project only half way out of the pattern lever bed 10, whereby also the foot 7 of the pattern sinker 4 can only project half way out of the sinker bed 6. This allows the foot 7 of the pattern sinker 4 to be engaged only by quite high parts of the cam.

Figure 12:
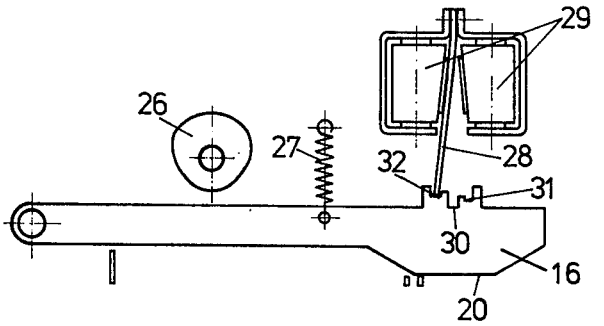
FIG. 12 is a schematic side elevation of a control strip released by the eccentric and held in the out position by the double electromagnet.

If now the double electromagnet 29 draws its armature towards the left, the latter moves into a further groove 32 in the control strip 16 as is shown in FIG. 12. The control strip 16 is thereby so retained that its actuating surface 20 hold's the foot 11 of the pattern lever 8 in position, into which it has been brought by the wiper 15. Accordingly the pattern lever 8 cannot move out of the pattern lever bed 10. The foot 7 of the pattern sinker 4 likewise remains sunk in the sinker bed 6 and cannot be engaged by any part of the cam.

Figure 13:
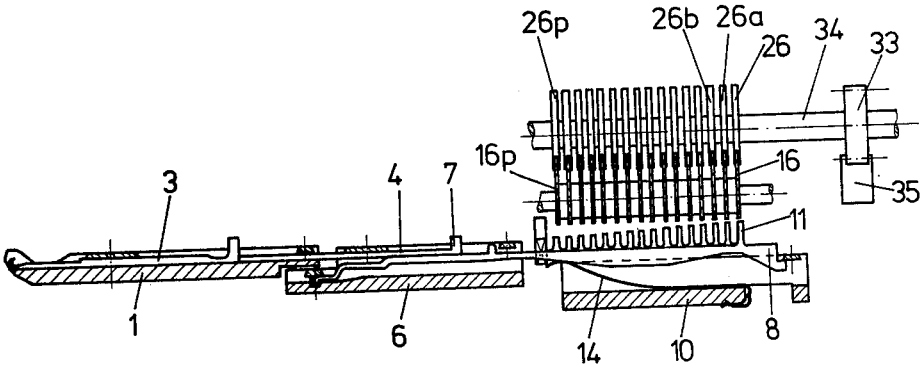
FIG. 13 is a cross section through the needle bed, sinker bed and pattern lever bed similar to FIG. 1 showing a set of eccentrics and the drive therefor.
Figure 14:
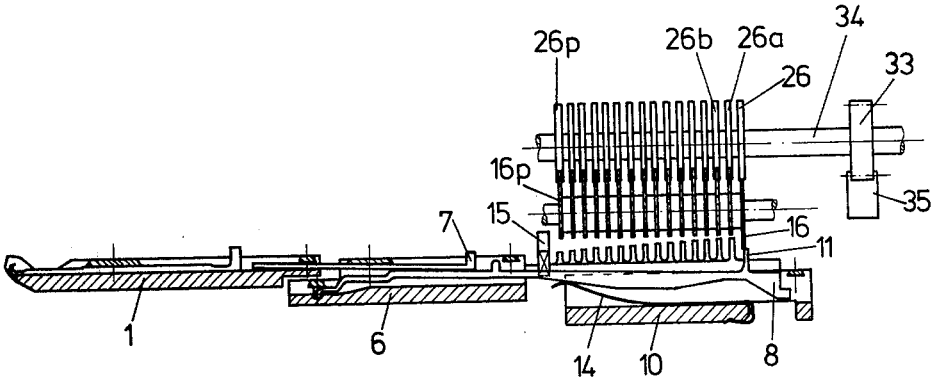
FIG. 14 is a cross section according to FIG. 13 with the control strips in the pressed condition.
Figure 15:
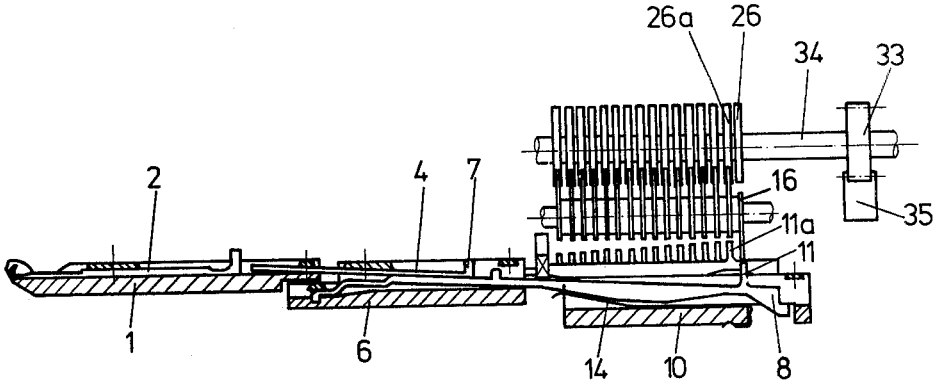
FIG. 15 is a cross section corresponding to FIG. 13 showing a depressed control strip released by the eccentric but retained by an electromagnet.
Figure 16:
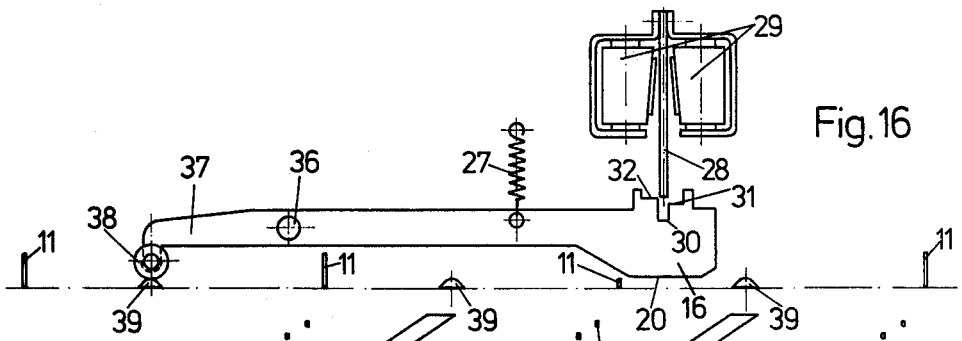
FIG. 16 is a schematic side elevation of a control strip mounted upon a double armed lever and controlled by actuating cams.
Figure 17:
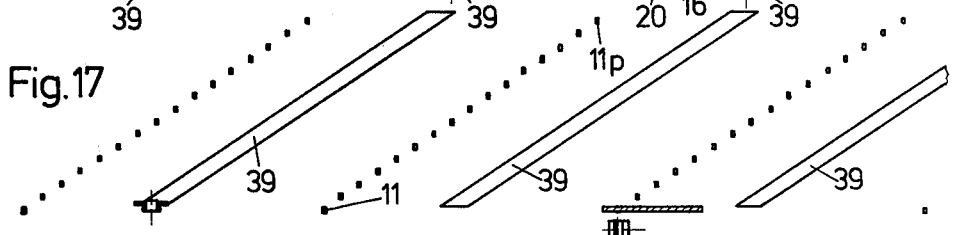
FIG. 17 is a plan view of the actuating cams according to FIG. 16, which show schematically the position of the actuating cams with reference to the diagonally staggered feet of the pattern levers.
Figure 18:
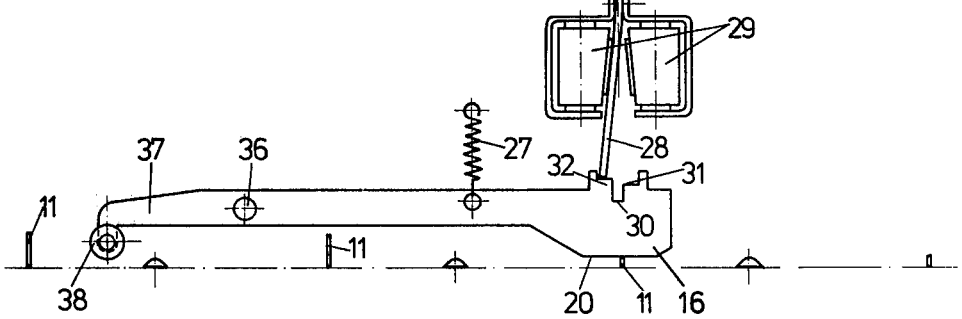
FIG. 18 is a side elevation corresponding to FIG. 16 with a control lever released by the operating cam and retained in the out position by a double magnet.
Figure 19:
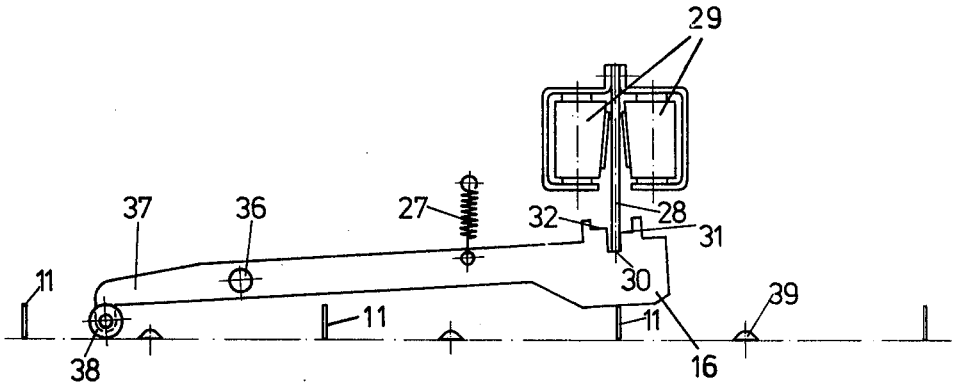
FIG. 19 is a side elevation corresponding to FIG. 16 showing an elevated control strip.

As shown in FIGS. 13 to 15, the eccentrics 26, 26*a* . . . 26*p* are mounted upon the shaft 34, at the end of which remote from the needle bed 1 there is mounted a pinion 33. The pinion 33 meshes with a rack secured to the machine frame so that the shaft 34 is driven synchronously with the carriage movement. The pinion 33 and the rack 35 are designed to suit the fineness of gauge of the machine.

FIG. 13 shows all of the eccentrics 26 and the control strips 16 in the rest position, whilst in FIG. 14 the eccentric 26, the control strip 16 together with the appertaining foot 11 are depressed into the half position. In FIG. 15 a control strip 16 and the foot 11 have been completely depressed and retained.

FIGS. 16 to 19 show the pattern mechanism with pattern levers, wherein the lever carrying the control strip 16 is designed as a double armed lever, which is pivotably mounted about a pivot 36. Upon the lever arm 37 remote from the control strip 16 there is carried a roller 38. Between the diagonally staggered rows of feet 11 . . . 11*p* of the pattern levers 8 there are likewise arranged diagonally directed switching cams 39. When, in the passage of the cam and the carriage, the roller 38 encounters a switch cam 39, then the control strip 16 is tilted downwardly, the spring 27 is tensioned and the actuating surface 20 of the control strip 16 is guided towards the needle bed or the cylinder. The retention of the control strip 16 in its particular operating position is effected by means of a double electromagnet 29 in the same way as the previously described example.

Figure 20:
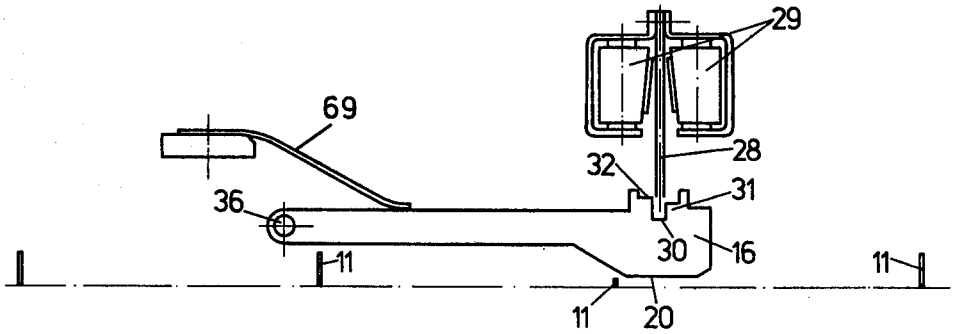
FIG. 20 is a schematic side elevation of a control strip arranged at the free end of a single armed lever, and which is pressed by a spring against the surface of the needle bed or the cylinder.

FIG. 20 shows a further practical form of a single armed lever for the control strip 16. By means of a spring 69 the lever is continuously pressed against the surface of the needle bed or the cylinder, and the control strip is raised, for example by the feet 11 of the pattern levers 8, into its operating position determined by the armature 28 of the double electromagnet 29.

Figure 21:
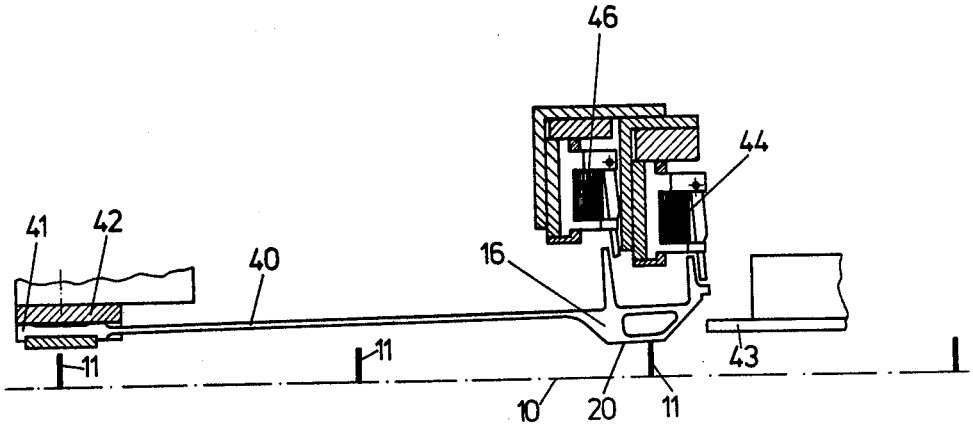
FIG. 21 is a side elevation of a spring lever clamped at one end, and at the free end a control strip, which is elevated by the foot of a pattern lever.
Figure 22:
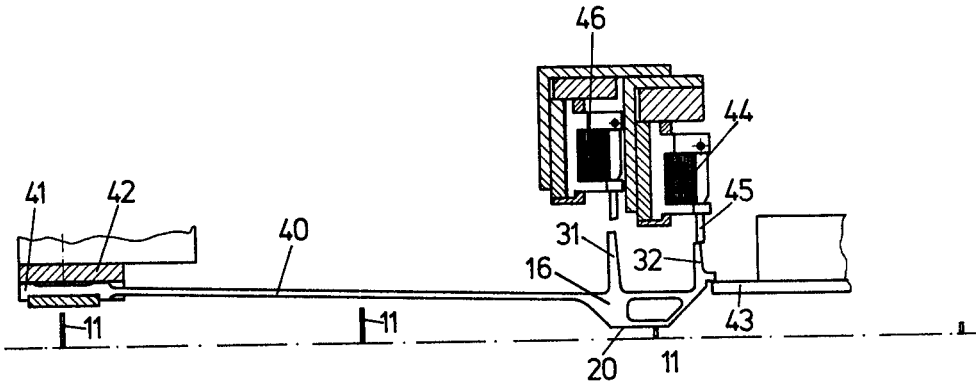
FIG. 22 is a side elevation corresponding to FIG. 21 with a control strip retained in the depressed position by an electromagnet.

A further practical form of a single armed lever for the control strip 16 is shown in FIGS. 21 and 22. The shaft 40 of the lever is self sprung and at one of its ends 41 is clamped securely in a bearing 42 in such a manner that the actuating surface 20 of the control strip 16 slides closely above the needle bed or cylinder. By means of a stop 43 the control strip is held in a lightly stressed condition at the necessary spacing from the needle bed. The spring force of the shaft 40 is substantially smaller than the spring force of the spring 14 of the pattern lever 8. If now during the travel of the carriage the actuating surface 20 of the control strip 16 encounters a foot 11 of the pattern lever 8, then the control strip 16 is pressed upwardly as is shown in FIG.

21. The foot 11 projects fully out of the pattern lever bed 10, which position is suitable for mesh formation.

Above the control strips there are provided electromagnets 44 and 46. If the electromagnet 44 attracts its armature 45, the control strip 16 is retained in its basic position and the pattern lever 8 cannot move out of its basic position in the pattern lever bed 10. It therefore remains sunk in the pattern lever bed 10, whereby also the foot 7 of the pattern sinker remains sunk in the sinker bed 6 in the position "not knitting". By switching in only the electromagnet 46 the control strip 16 may be held in the half position, i.e. the tuck position, as may be likewise seen from FIG. 22.

Figure 23:
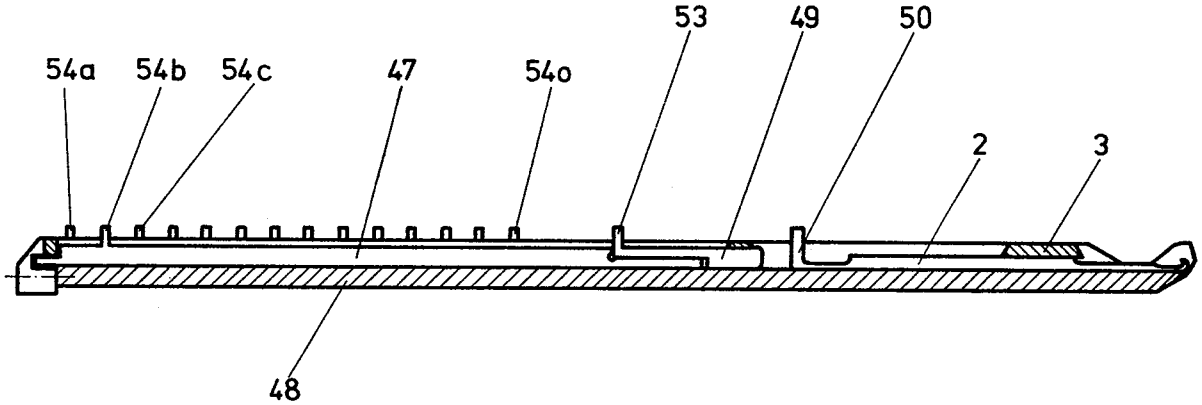
FIG. 23 is a cross section through a needle bed with pattern sinkers movable in the direction of the needles and having feet in staggered formation.

In the FIGS. 23 to 29 there is shown a further pattern mechanism with appertaining parts, wherein pattern sinkers 47, which are movable in the direction of the needles, are selected and control the needles 2. For this purpose a wider needle bed 48 is necessary, which, however, has the advantage that the needle channels are not so deep. As is seen in FIG. 23, in this needle bed 48 the needles 2 are displaceably mounted and are covered by a cover rail 3. In accordance with the pattern, an intermediate sinker 49, acting upon the foot of the needle, displaces it to the desired selection point in a needle cam, which is shown in more detail in FIGS. 28 and 29.

Figure 24:
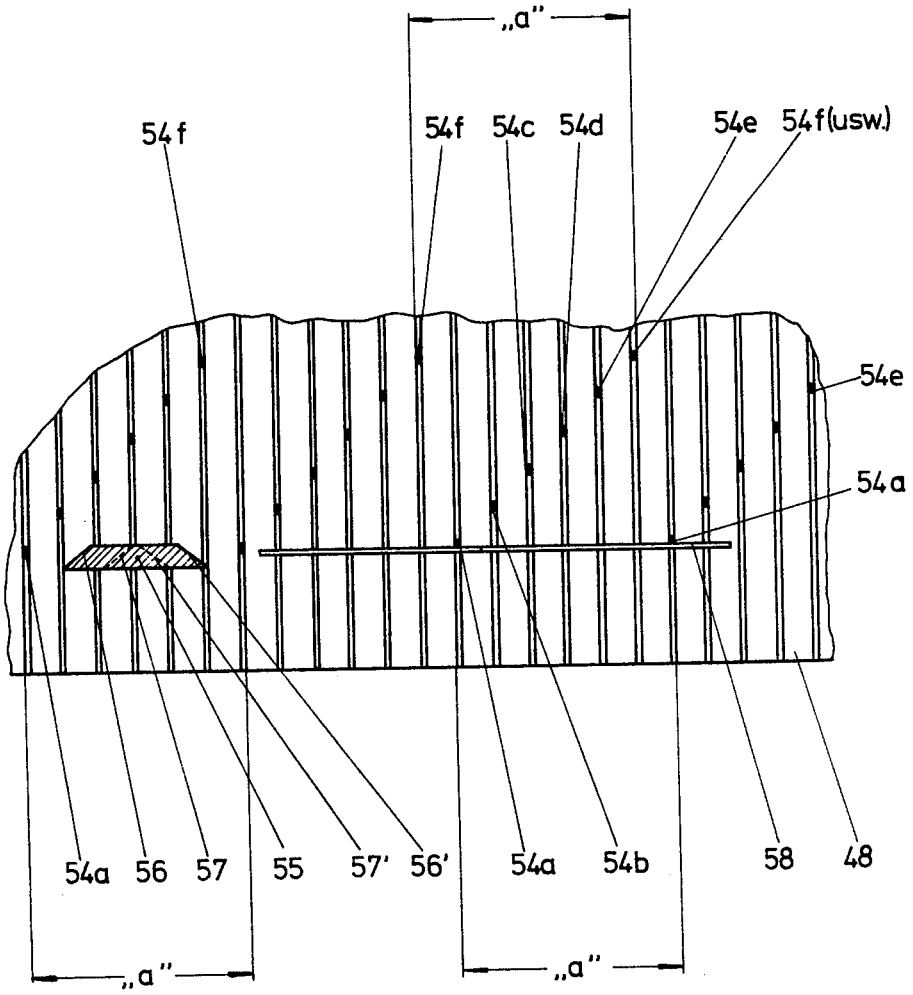
FIG. 24 is a plan view of a portion of a needle bed according to FIG. 23 and shows in section a lifting member travelling in one row.
Figure 28:
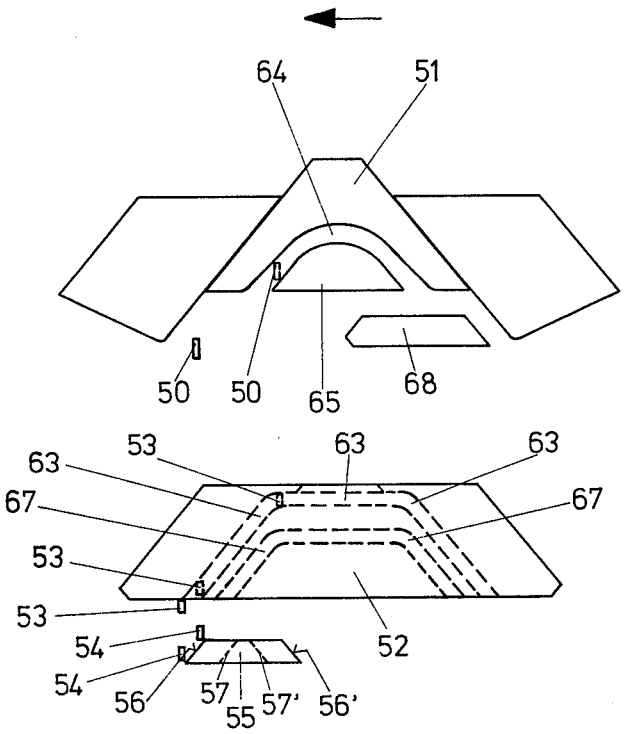
FIG. 28 is a plan view on a knitting cam, an appertaining pattern cam and a lifting member displaced with respect to the advancing selection point, the lifting member being in the full position for the selection of mesh knitting, together with an arrangement according to FIG. 25.
Figure 29:
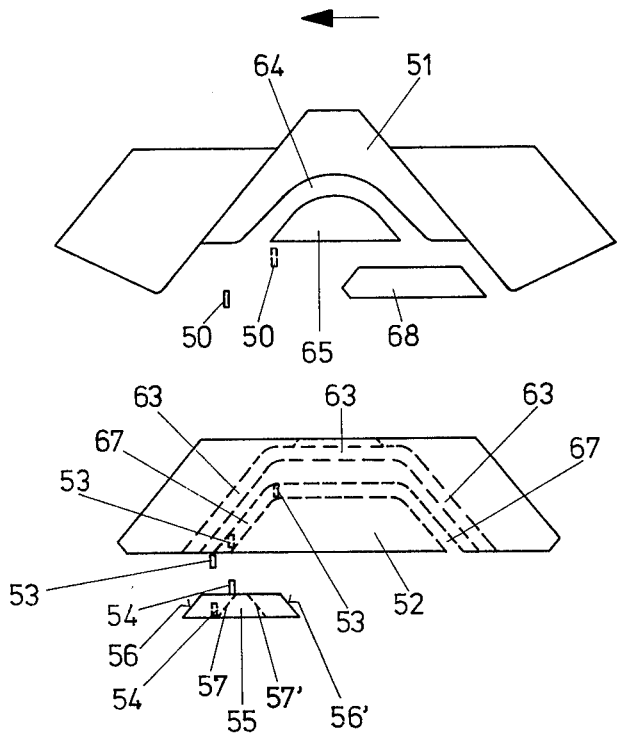
FIG. 29 is a plan view corresponding to FIG. 28, in which a lifting member is brought into the half position for the formation of loops.

The intermediate sinker 49, the foot of which passes through a pattern cam, likewise shown in more detail in FIGS. 28 and 29, is itself selected by the pattern sinker 47 lying behind it in the needle bed 48. The pattern sinkers 47 are provided with feet 54*a*, 54*b*, 54*c*, . . . 54*o*, which in succeeding pattern sinkers 47 are staggered into different positions. Between each two successive feet positioned in the length of the needle bed, there is a free path *a* as shown in FIG. 24, in which, upon passage of the carriage, there is moved a lifting member 55 having lifting inclines 56, 57 and 56', 57'.

Figure 25:
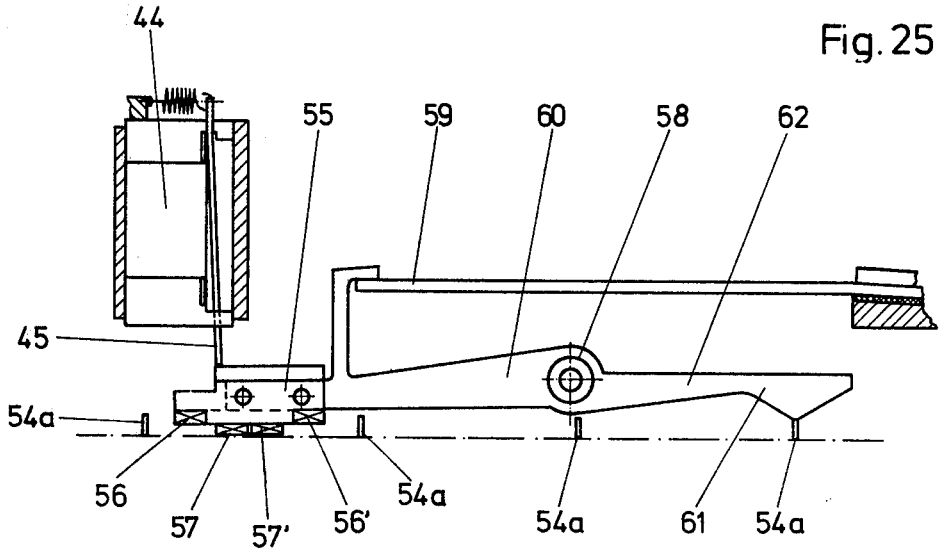
FIG. 25 shows a side elevation of a double armed lever with lifting members mounted at one end thereof, which are pressed towards the surface of the needle bed or the cylinder by an adjacent foot of another pattern sinker through the agency of the double armed lever, and retained in that position by an electromagnet.
Figure 26:
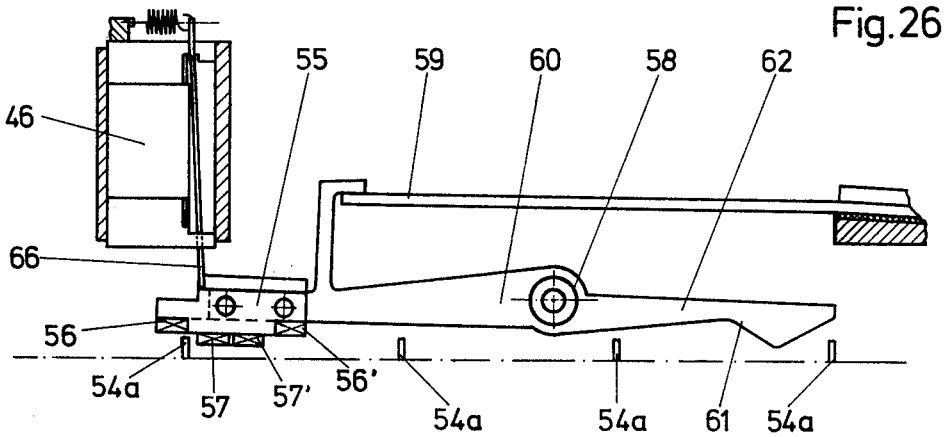
FIG. 26 is a side elevation corresponding to FIG. 25 after release of the lever by the adjacent foot of the other pattern sinker and its retention in the half position by another electromagnet.
Figure 27:
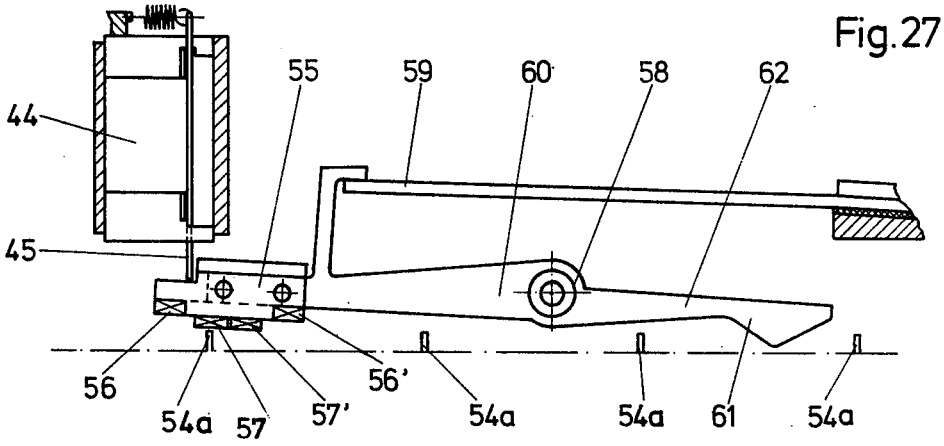
FIG. 27 is a side elevation corresponding to FIG. 25 after the release of the lever by the adjacent foot of the other pattern sinker and after release of the lifting member by the first electromagnet.

The movement of the lifting member 55, which here represents the control member, may be seen from FIGS. 25 to 27. A double armed lever 58 is pivotally mounted upon the carriage. By means of a spring 59 the lever is biased always into a basic position in such a manner that its lever arm 60, to which the lifting member 55 is secured, always holds the latter out of engagement with the feet 54 as shown in FIG. 27. Upon the other lever arm 62 there is provided an incline 61. Upon passage of the carriage, this second lever arm 62 is lifted by cooperation of the incline 61 with, for example, an adjacent foot 54*a*, whereby the lever 58 stresses the spring 59. According to the height of the foot 54*a* the lever arm 60 is tilted so far downwardly that the lifting member 55 is brought into position close to the surface of the needle bed 48 or the cylinder.

If now the lever 58 is retained in this position by the armature 45 of the electromagnet 44, then the subsequent feet 54*a* are engaged by the inclines 56 or 56' of the lifting member 55 and, by means of the pattern sinker 47, push the foot 53 of the intermediate sinker 49 into a channel 63 of the pattern cam 52 shown in FIGS. 28 and 29. Thereby the intermediate sinker 49 brings the foot 50 of the needle 2 into a channel 64 of a needle cam shown in FIGS. 28 and 29, and is driven by a needle lifter 65 to form meshes.

If now, by means of an armature 66 of a further electromagnet 46, or by time delay effected by the control of the armature 45 of the electromagnet 44, the lever arm 60 is arrested in the next stage or half position, as is shown in FIG. 26, then the feet 54*a* are engaged by the deeper and further inwardly situated inclines 57 or 57' of the lifting member 55. The particular pattern sinker 47 then pushes the foot 53 of the intermediate sinker 49 into a channel 67 of the pattern cam 52. The intermediate sinker 49 thereby brings the needle 2 having the foot 50 underneath the needle lifter 65, and the foot 50 will then only be engaged by a tucking bridge 68 for loop formation, as is represented in FIG. 29. The tucking bridge 68 is so connected that it has a following function in the rhythm of the machine.

In flat knitting machines the sets 18 and 19 of control members, which in this case are fitted with levers 58, are in each case allocated to the leading selection point, as represented in FIGS. 6 and 7. In this way, as already explained, the required number of selection elements and of the members controlling them, for example the electromagnets, is reduced by one half as compared with non-displaceable sets. The long axis of the lever 58 is directed substantially in the direction of carriage movement. At the end of the lever arm 62, the feet 54 of the pattern sinkers 47 form switching cams for moving the lever 58 into a position, in which the feet 54 of other pattern sinkers 47, which are spaced away at a distance of at least twice the length of the free path *a*, can be engaged by the lifting member 55.

The electromagnets 29, 44, 46 situated upon the carriage can be controlled by an electronic control arrangement, either on-line or off-line, by means of a connecting cable or other transmitting means.

It is evident that those skilled in the art may make numerous modifications of the specific embodiments described above without departing from the present inventive concepts. It is intended accordingly that the invention shall be construed as embracing each and every novel feature and novel combination of features present in or possessed by the apparatus herein described and that the foregoing disclosure shall be read as illustrative and not as limiting except to the extent set forth in the claims appended hereto.

We claim:

1. A knitting machine pattern mechanism comprising a needle support means, a plurality of needle control means movably carried by said needle support means, butt means on each of said needle control means, said butt means being in staggered formation, cam means movable relative to said needle support means, a plurality of control members for selectively determining the positions of said needle control means, means mounting said control members for movement relative to the needle support means between two of said butt means positioned successively in the direction of cam movement, and means operative to mechanically move said control members to and retain said control members in selected positions appropriate to a particular pattern.

2. A knitting machine pattern mechanism according to claim 1 wherein said control members are adapted to move said needle control means to a selected one of three positions of relatively closer adjacency to said needle support means for each movement of said cam means.

3. A knitting machine pattern mechanism according to claim 1 wherein said needle support means comprises a needle bed, a pattern sinker bed and a pattern lever bed, and wherein each of said needle control means comprises a pattern sinker carried by said pattern sinker bed and a pattern lever carried by said pattern lever bed.

4. A knitting machine pattern mechanism according to claim 1 having a plurality of said cam means, and means grouping said plurality of control members into a plurality of sets each associated with a respective one of said cam means and each corresponding in number to the number of said butt means.

5. A knitting machine pattern mechanism according to claim 4 having means for displacing said sets of control members together with selection positions of said cam means in the direction of movement thereof.

6. A knitting machine pattern mechanism according to claim 4 having means for selectively moving said sets of control members separately to selection positions in the direction of cam movement.

7. A knitting machine pattern mechanism according to claim 1 wherein said means for retaining said control members comprises electromagnetic means.

8. A knitting machine pattern mechanism according to claim 2 wherein said means for retaining said control members comprises electromagnetic means actuable to retain said control member in a selected one of three positions corresponding respectively to said three positions of said needle control means.

9. A knitting machine pattern mechanism according to claim 1 wherein each of said control members comprises a control strip carried by a lever, and wherein said means for mechanically moving said control members comprises a plurality of eccentrics having angularly staggered peripheries, each eccentric being adapted to pivot a respective one of said levers, means driving said plurality of eccentrics in synchronism with the speed of movement of said cam means, and spring means urging each of said levers into engagement with the periphery of the associated one of said eccentrics.

10. A knitting machine pattern mechanism according to claim 1 wherein each of said control members comprises a control strip carried by one arm of a two-armed lever and wherein said means for mechanically moving said control members comprises actuating cams located between said butt means and adapted to operate on the other arms of said levers, and spring means urging each of said levers toward said cams.

11. A knitting machine pattern mechanism according to claim 1 wherein each of said control members comprises a control strip carried by an arm, wherein means is provided to resiliently urge said control strip toward said needle control means, for movement into said positions by said butt means.

12. A knitting machine pattern mechanism according to claim 11 wherein each of said arms carries said control strip at one end thereof and is pivoted at the other end thereof, said means resiliently urging said arms comprising spring means acting on said arm between said ends thereof.

13. A knitting machine pattern mechanism according to claim 11 wherein each of said arms is resilient and wherein stop means is provided to limit movement of said control strips toward said needle control means.

14. A knitting machine pattern mechanism according to claim 1 wherein said needle support means comprises a needle bed in a flat knitting machine.

15. A knitting machine pattern mechanism according to claim 1 wherein said control members are elongated substantially in the direction of movement of the cam means.

16. A knitting machine pattern mechanism according to claim 1 wherein each of said needle control means comprises a pattern sinker movable in the direction of movement of an associated needle, and wherein each of said control members comprises a lifting control member.

17. A knitting machine pattern mechanism according to claim 16 wherein said lifting control members comprise levers having lifting members mounted thereon at two respective spacings from said needle support means, said lifting members having lifting inclines at a first spacing for the selection of tuck stitch knitting located to be operative later than lifting inclines at the second spacing for the selection of mesh knitting.

18. A knitting machine pattern mechanism according to claim 17 wherein said levers comprise double armed levers having said lifting members mounted at one end thereof.

19. A knitting machine pattern mechanism according to claim 18 having spring means urging said double armed levers to move said lifting members from said needle support means, and means mounting said levers for movement towards said needle support means by engagement of said double armed levers with said butt means.

20. A pattern mechanism for a knitting machine comprising:

a needle bed means, a plurality of pattern sinkers movably carried on said needle bed means in side by side relation, a plurality of pattern levers each carried on said needle bed means for movement to cause movement of a respective one of said pattern sinkers toward or away from the needle bed means, butt means on each of said pattern levers, said butt means being in staggered formation, cam means movable transversely of said pattern sinkers for actuation thereof, a plurality of control members, each control member being movable for engagement with a respective one of said butt means to position the associated one of said pattern levers in a selected one of three positions of relatively closer adjacency to said needle bed means at each movement of said cam means in accordance with a particular pattern, mechanical means adapted to move each of said control members toward said needle bed means between two of said butt means and means for retaining each of said control member in a selected one of three positions corresponding respectively to said three positions of relative adjacency to said needle bed means of said pattern levers.

21. A pattern mechanism for a knitting machine comprising: a needle bed means, a plurality of pattern sinkers movably carried on said needle bed means in side by side relation, butt means on each of said pattern sinkers, said butt means being in staggered formation, cam means movable transversely of said pattern sinkers for actuation thereof, a plurality of lifting control members, each lifting control member being movable for engagement with a respective one of said butt means to position the associated one of said pattern sinkers in a selected position relative to said needle bed means at each movement of said cam means in accordance with a particular pattern, mechanical means adapted to move each of said lifting control members towards said needle bed means between two of said butt means, and means for retaining each of said lifting control members in a selected one of positions corresponding respectively to said positions of relative adjacency to said needle bed means, of said pattern sinkers.

* * * * *